US009035974B2

(12) United States Patent
Choi et al.

(10) Patent No.: US 9,035,974 B2
(45) Date of Patent: May 19, 2015

(54) DISPLAY APPARATUS AND CONTROL METHOD FOR SAVING POWER THEREOF

(71) Applicant: Samsung Display Co., Ltd., Yongin, Gyeonggi-Do (KR)

(72) Inventors: Byeong-Hwa Choi, Yongin (KR); Seung-Bae Lee, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 134 days.

(21) Appl. No.: 13/799,180

(22) Filed: Mar. 13, 2013

(65) Prior Publication Data

US 2014/0139557 A1 May 22, 2014

(30) Foreign Application Priority Data

Nov. 19, 2012 (KR) ..... 10-2012-0131116

(51) Int. Cl.
*G09G 5/10* (2006.01)
*G09G 3/22* (2006.01)

(52) U.S. Cl.
CPC ..... *G09G 3/22* (2013.01)

(58) Field of Classification Search
None
See application file for complete search history.

(56) References Cited

U.S. PATENT DOCUMENTS

| | | | | |
|---|---|---|---|---|
| 8,203,551 | B2 | 6/2012 | Plut | |
| 8,207,934 | B2 | 6/2012 | Plut | |
| 2005/0052446 | A1 | 3/2005 | Plut | |
| 2005/0264702 | A1 | 12/2005 | Yoshii | |
| 2005/0270283 | A1 | 12/2005 | Plut | |
| 2005/0275651 | A1 | 12/2005 | Plut | |
| 2006/0232216 | A1 | 10/2006 | Kosaka | |
| 2009/0109246 | A1 | 4/2009 | Oh | |
| 2009/0245280 | A1 | 10/2009 | Rajamani | |
| 2010/0214325 | A1* | 8/2010 | Koyama et al. | 345/690 |
| 2011/0205202 | A1 | 8/2011 | Son et al. | |

FOREIGN PATENT DOCUMENTS

| | | |
|---|---|---|
| KR | 1020050036245 | 4/2005 |
| KR | 1020090042606 | 4/2009 |
| KR | 1020100127876 | 12/2010 |
| KR | 1020110097049 | 8/2011 |
| KR | 1020120066504 | 6/2012 |

* cited by examiner

*Primary Examiner* — Muhammad N Edun
(74) *Attorney, Agent, or Firm* — Robert E. Bushnell, Esq.

(57) ABSTRACT

In a method and a device for controlling luminance of a display unit to save power of a display device including the display unit for displaying on a screen, the method includes: calculating a second luminance to which the luminance of the display unit is to be changed considering a first luminance that is a current luminance of the display unit and a constant K determined according to Weber's law; and changing the luminance of the display unit to the second luminance.

20 Claims, 3 Drawing Sheets

DISPLAY APPARATUS AND CONTROL METHOD FOR SAVING POWER THEREOF

CLAIM OF PRIORITY

This application makes reference to, incorporates into this specification the entire contents of, and claims all benefits accruing under 35 U.S.C. §119 from an application earlier filed in the Korean Intellectual Property Office filed on Nov. 19, 2012 and there duly assigned Serial No. 10-2012-0131116.

BACKGROUND OF THE INVENTION

1. Field of the Invention

The present invention relates to a power saving method and device for a display device, and more particularly to a display device for controlling the brightness of a display unit based on a minimal brightness difference recognizable by a user, and a method of controlling the display device.

2. Description of the Related Art

A display device consumes power mostly for screen output. As image quality is improved and a screen size is increased, power consumption increases. When there is a great amount of central processing unit (CPU) operations or graphic processing and calculation operations, power consumption also increases. Use of a communication service also increases power consumption.

Recently, as portable display devices have been widely used, it is necessary to use various power saving modes in order to reduce power consumption of a display device. Unlike a typical fixed-type display device that is continuously supplied with power through a socket, a portable display device is limited in power, and thus an efficient power saving method is required.

To reduce power consumption of a portable display device, screen brightness is decreased, or an automatic screen lock function is performed to switch to a standby mode when there is no input from a user for a certain period of time. For instance, when the user selects a power saving mode, a screen may be kept dark according to the power saving mode. However, when the power saving mode is set, the user recognizes a change in a display state and thus may feel that it is unnatural.

SUMMARY OF THE INVENTION

The present invention provides a display device for controlling the brightness of a display unit based on a minimal brightness difference recognizable by a user, and a method of controlling the display device.

According to an aspect of the present invention, there is provided a method of controlling the luminance of a display unit in order to save power of a display device including the display unit for displaying on a screen, the method including: calculating a second luminance to which the luminance of the display unit is to be changed considering a first luminance that is a current luminance of the display unit and a constant K determined according to Weber's law; and changing the luminance of the display unit to the second luminance.

According to another aspect of the present invention, there is provided a device for controlling the luminance of a display unit in order to save power of a display device including the display unit for displaying on a screen, the device including: a luminance calculation unit configured to calculate a second luminance to which the luminance of the display unit is to be changed considering a first luminance that is a current luminance of the display unit and a constant K determined according to Weber's law; and a luminance control unit configured to change the luminance of the display unit to the second luminance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to one of ordinary skill in the art. Furthermore, the present invention is only defined by the scope of the claims.

The terminology used herein is not for limiting the present invention but is for describing the embodiments. The terms of a singular form may include plural forms unless otherwise specified. The meaning of "include", "comprise", "including", or "comprising" specifies a property, a region, a fixed number, a step, a process, an element and/or a component but does not exclude other properties, regions, fixed numbers, steps, processes, elements and/or components.

Detailed descriptions related to well-known functions or configurations will be ruled out in order to clearly describe the embodiments.

Figure 1:
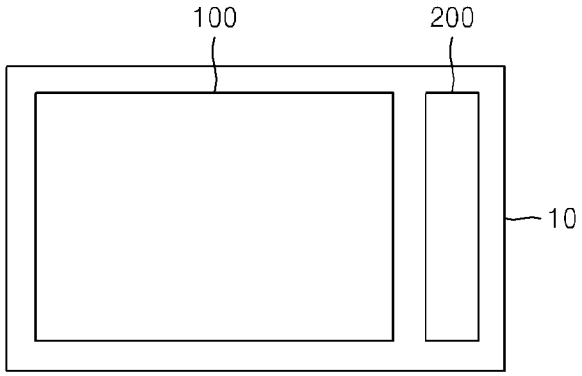
FIG. 1 illustrates a display device according to an embodiment of the present invention.

FIG. 1 illustrates a display device according to an embodiment of the present invention. Referring to FIG. 1, the display device 10 may include a display unit 100 and a control unit 200. The display unit 100 displays a screen, and the control unit 200 controls luminance of the display unit 100. A position of the control unit 200 illustrated in FIG. 1 is just an example, and the position of the control unit 200 is not limited thereto. The control unit 200 may be located on any location on an edge region where the display unit 100 is not located. The control unit 200 may also overlap the display unit 100 so as to be located on the back thereof, or may be located on an additional device that is electrically connected to the display device 10.

Figure 2A:
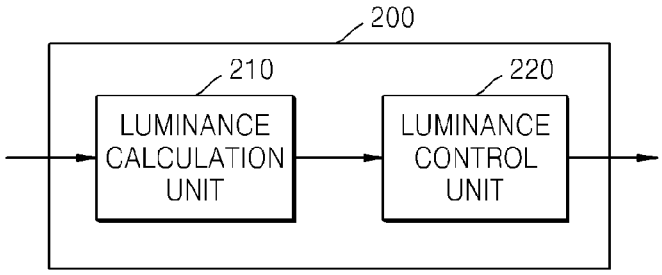
FIG. 2A illustrates a configuration of the control unit of FIG. 1 according to an embodiment of the present invention.

FIG. 2A illustrates a configuration of the control unit of FIG. 1 according to an embodiment of the present invention.

Referring to FIG. 2A, the control unit 200 may include a luminance calculation unit 210 and a luminance control unit 220. The control unit 200 may control luminance of the display unit 100 so as to reduce power consumption of the display device 10 including the display unit 100 for displaying on a screen. For instance, to save power of the display device 10, the control unit 200 may change the luminance of the display unit 100 to such a degree that the change is not recognizable by a user.

The luminance calculation unit 210 may consider a first luminance that is a current luminance of the display unit 100 and a constant K determined by Weber's law to calculate a second luminance to which the luminance of the display unit 100 is to be changed. For instance, the luminance calculation unit 210 may calculate the second luminance in accordance with Equation (1) below.

$$\left|\frac{L2 - L1}{L1}\right| \leq K \tag{1}$$

where L1 may denote the current luminance, i.e. the first luminance, of the display unit 100, L2 may denote the second luminance, and K may denote a user-defined constant. Equation (1) follows Weber's law.

Weber's law indicates that, when a sensory organ is stimulated, a stimulus should be given to the sensory organ in a constant ratio relative to the original stimulus in order for the sensory organ to notice a change in stimulus. According to Weber's law, if a weak stimulus is initially given, a change in stimulus may be easily perceived even if the change is small. However, if a strong stimulus is initially given, the stimulus change should be increased in order to perceive the stimulus change.

That is, a change ratio between a current stimulus and a next stimulus should be at least a constant ratio in order for the sensory organ to perceive the change. This ratio may be defined as Weber's constant. Therefore, the user-defined constant K of Equation (1) may be Weber's constant according to Weber's law.

Values of the Weber's constant may be different for different sensory organs. As a value of Weber's constant decreases, a sensory organ is more sensitive. Even if Weber's constant is for the same sensory organ, Weber's constant may be differently defined according to users of the display device 100 or various environments such as ambient brightness and the luminance of the display unit 100.

According to an embodiment of the present invention, the constant K may be preset by a user. To this end, the user may conduct an experiment based on a certain environment where the display device 10 is used with a certain viewer, and may set the constant K based on a result of the experiment.

For instance, based on the current luminance, i.e. the first luminance L1, of the display unit 100, a just noticeable difference (JND) that is a minimal difference noticeable by a user is obtained. Then, from a ratio between the obtained JND and the first luminance, the constant K may be set as expressed in Equation (2).

$$K = \frac{JND}{L1} \tag{2}$$

According to experiments, in the case of the sense of sight, Weber's constant is obtained as about 1/40 to about 1/100. However, Weber's constant is not limited thereto and may be differently set according to environments where the present invention is carried out. For instance, Weber's constant may be differently set according to an average luminance of the display unit 100 according to uses of the display device 10, or may be differently set according to whether the display device 10 is mainly used indoors or outdoors, or may be differently set according to an age group of main users of the display device 10. Besides these factors, there may be other factors.

To this end, a lookup table may be prepared after pre-obtaining values of Weber's constant corresponding to respective situations through experiments, and a value of Weber's constant corresponding to a respective situation may be set to the constant K with reference to the lookup table. For convenience, the smallest value among the obtained Weber's constants may be set to the constant K.

As the luminance calculation unit 210 calculates the second luminance L2 based on the constant K set as mentioned above, a user may not perceive a change in luminance when the luminance of the display unit 100 is changed from the first luminance to the second luminance by the luminance control unit 220. Accordingly, a power saving function of the display device 10 may be performed without the user feeling that it is unnatural.

The luminance control unit 220 may change the luminance of the display unit 100 from the first luminance to the second luminance calculated by the luminance calculation unit 210. The second luminance is calculated from the first luminance and the constant K determined according to Weber's law using Equation (1), and the constant K in Equation (1) is Weber's constant for the sense of sight. Therefore, when the luminance of the display unit 100 is changed from the first luminance to the second luminance by the display unit 100, a user may not perceive the luminance change. Accordingly, the power saving function of the display device 10 may be performed without the user feeling that it is unnatural.

The luminance calculation unit 210 and the luminance control unit 220 may repeatedly calculate and change luminance according to remaining power of the display device 10 or according to a time interval. For instance, the luminance calculation unit 210 and the luminance control unit 220 may change the luminance of the display unit 100 whenever the remaining power of the display device 10 decreases by as much as a certain amount.

The certain amount may be calculated as a percentage of current remaining power with respect to 100% chargeable power of the display device 10. For instance, the luminance calculation unit 210 and the luminance control unit 220 may change the luminance of the display unit 100 whenever the remaining power of the display device 10 decreases by about 1%. The numerical value of 1% is just an example, and the certain amount is not limited thereto. This numerical value may be differently set according to a degree of power saving.

Otherwise, the certain amount may be an absolute quantity of the remaining power of the display device 10. The remaining power of the display device 10 may be expressed in units of Ah or mAh. Accordingly, the luminance calculation unit 210 and the luminance control unit 220 may change the luminance of the display unit 100 whenever the remaining power of the display device 10 decreases by about 1 mAh. The numerical value of 1 mAh is just an example, and the certain amount is not limited thereto. This numerical value may be differently set according to a desired degree of power saving.

Figure 2B:
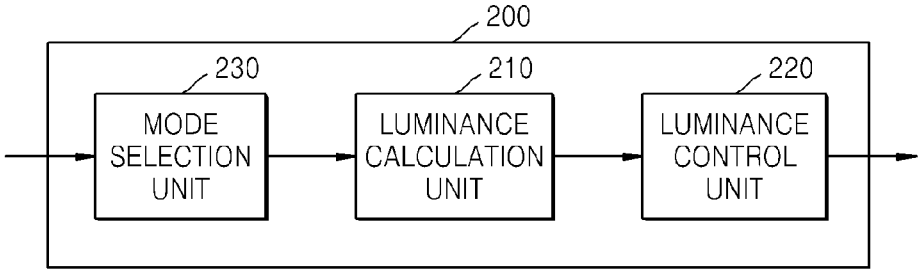
FIG. 2B illustrates a configuration of the control unit of FIG. 1 according to another embodiment of the present invention.

FIG. 2B illustrates a configuration of the control unit of FIG. 1 according to another embodiment of the present invention. Referring to FIG. 2B, the control unit 200 may include a mode selection unit 230, a luminance calculation unit 210, and a luminance control unit 220.

The mode selection unit 230 may select one of a plurality of modes differentiated by maximal luminance of the display unit 100 according to a selection by a user. A degree of power saving of the display device 10 may be differently set according to the mode selection. The plurality of modes may differently set the maximal luminance of the display unit 100.

The luminance calculation unit 210 may consider the mode selected by the mode selection unit 230, the first luminance that is a current luminance of the display unit 100, and the constant K determined by Weber's law to calculate the second luminance to which the luminance of the display unit 100 is to be changed using Equation (1).

First Embodiment

According to an embodiment of the present invention, maximal luminance corresponding to each mode may be luminance obtained when the remaining power of the display device 10 is 100%. Hereinafter, the luminance obtained when the remaining power of the display device 10 is 100% is referred to as initial luminance. Accordingly, the plurality of modes may differently set the maximal luminance of the display unit 100.

According to an embodiment of the present invention, the second luminance may have a smaller value than that of the first luminance. Accordingly, the luminance of the display unit 100 may be gradually decreased as a result of control by the control unit 200, and the initial luminance set according to each mode may be set to the maximal luminance so that the luminance is gradually decreased from the maximal luminance.

For instance, the luminance of the display unit 100 may be gradually decreased as a result of control by the control unit 200 according to the remaining power of the display device 10 or according to a time interval. According to this configuration, as the display device 10 consumes power, or as time passes, the luminance of the display unit 100 is gradually decreased, thereby reducing power consumption of the display device 10. Here, a user may not perceive the decrease in the luminance due to Weber's law even if the luminance of the display unit 100 is changed. An example of a luminance change is described below with reference to FIG. 3.3.

Figure 3:
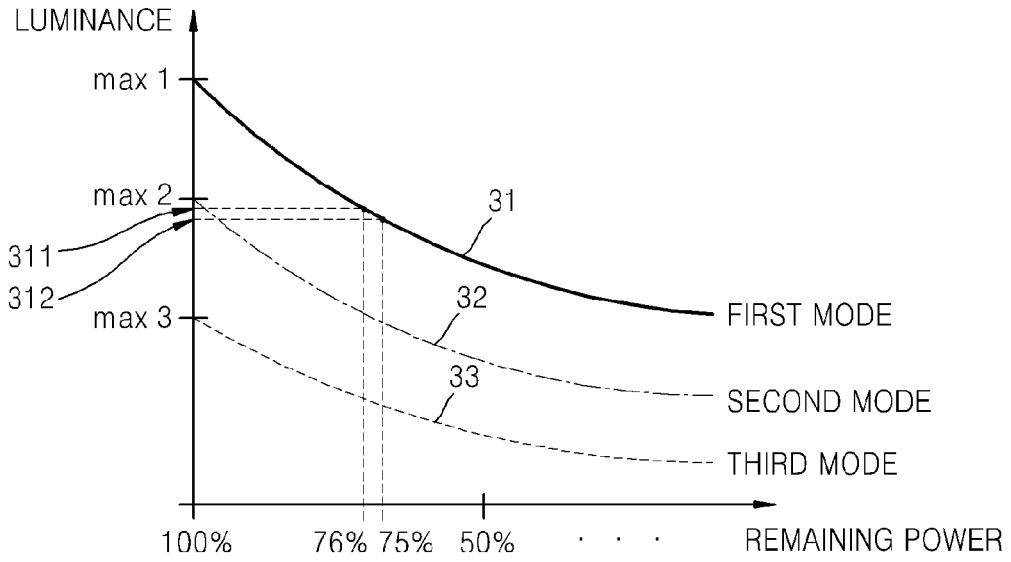
FIG. 3 is a graph illustrating an example where luminance is controlled by the control unit of FIG. 2B.

FIG. 3 is a graph illustrating an example in which luminance is controlled by the control unit of FIG. 2B. A curve 31 of FIG. 3 indicates a change in luminance when a first mode is selected by the mode selection unit 230. A curve 32 indicates a change in luminance when a second mode is selected by the mode selection unit 230. A curve 33 indicates a change in luminance when a third mode is selected by the mode selection unit 230.

Although FIG. 3 exemplarily illustrates the first to third modes, the types of modes are not limited thereto. The types and number of modes selected by the mode selection unit 230 may be variously set, as necessary.

The plurality of modes may differently set the maximal luminance of the display unit 100. Referring to FIG. 3, the maximal luminance of the display unit 100 may be max1 when the first mode is selected, the maximal luminance of the display unit 100 may be max2 when the second mode is selected, and the maximal luminance of the display unit 100 may be max3 when the third mode is selected.

The horizontal axis of the graph of FIG. 3 may represent the remaining power of the display device 10, and the vertical axis may represent the luminance of the display unit 100 according to the remaining power of the display device 10. Referring to FIG. 3, the maximal luminance max1 to max3 of respective modes may be the initial luminance obtained when the remaining power of the display device 10 is 100%.

The luminance of the display unit 100 may be gradually decreased as illustrated in FIG. 3. Here, regarding an interval of changing the luminance of the display unit 100, as described above, the luminance of the display unit 100 may be changed whenever the display device 10 consumes power by as much as the certain amount or may be changed according to a time interval. In FIG. 3, the horizontal axis represents the remaining power of display device 10 in order to illustrate that the luminance of the display unit 100 is changed according to the remaining power of the display device 10.

For instance, the luminance is repeatedly calculated and changed whenever the remaining power of the display device 10 decreases by about 1% as described below. Referring to FIG. 3, when the remaining power of the display device 10 decreases from about 76% to about 75% in the first mode, the luminance calculation unit 210 may calculate a second luminance 312 of the display unit 100 from Equation (1) considering a first luminance 311 of the display unit 100 and the constant K determined by Weber's law.

As the luminance is repeatedly calculated based on Equation (1), the luminance of the display unit 100 may be calculated as indicated by the curves 31 to 33, and may be gradually changed as indicated by the curves 31 to 33.

Since Equation (1) is based on Weber's law, when the luminance of the display unit 100 is changed according to the curves 31 to 33 derived based on Equation (1), a user may not perceive the change in the luminance of the display unit 100. Accordingly, the power saving function of the display device 10 may be performed without the user feeling that it is unnatural.

Although the horizontal axis of FIG. 3 represents the remaining power in order to illustrate that the luminance of display unit 100 is controlled based on the remaining power of the display device 10, the horizontal axis is not limited thereto. The luminance of the display unit 100 may be controlled according to a time interval. In this case, the horizontal axis of FIG. 3 may represent time.

In addition, according to a modified embodiment of the present invention, a user may set the luminance of the display unit 100 so that the luminance is greater than a certain minimal value even if the luminance is gradually decreased. Accordingly, even if the luminance of the display unit 100 is decreased as illustrated in FIG. 3, the luminance may not be decreased below the certain minimal value.

Second Embodiment

According to another embodiment of the present invention, the luminance of the display unit 100 may periodically alternate between increasing and decreasing according to the remaining power of the display device 10 or according to a time interval. Maximal luminance corresponding to a mode selected by the mode selection unit 230 may be maximal luminance obtained when the luminance of the display unit 100 periodically alternates. Accordingly, the second luminance of the display unit 100 may be lower than or higher than the first luminance.

The luminance calculation unit 210 may calculate the second luminance considering the first luminance and the constant K determined according to Weber's law so that the luminance of the display unit 100 periodically alternates within a range not exceeding the maximal luminance selected by the mode selection unit 230. The luminance control unit 220 may change the luminance of the display unit 100 according to the second luminance selected by the luminance calculation unit 210.

For instance, the luminance of the display unit 100 may be periodically increased and decreased under the control of the control unit 200 according to the remaining power of the display device 10 or according to a time interval. According to this configuration, as the remaining power of the display device 10 varies, or as time passes, the luminance of the display unit 100 is repeatedly decreased and increased within a range not exceeding the maximal luminance set by a user.

As described above, when the luminance of the display unit 100 is changed once, an amount of the change may satisfy Weber's law. In addition, the maximal and minimal values of the luminance of the display unit 100 may satisfy Weber's law when the luminance periodically alternates. That is, a ratio of a difference between the maximal value and the minimal value to the maximal value or a ratio of the difference between the maximal value and the minimal value to the minimal value may be less than Weber's constant. Here, as described above, Weber's constant K may be preset by a user, and the lookup table generated by pre-obtaining the values of Weber's constants corresponding to respective situations may be referred to.

By periodically alternating the luminance of the display unit 100, the luminance of the display unit 100 is averagely decreased, and thus the power consumption of the display device 10 is reduced in comparison with the case where the luminance of the display unit 100 is constantly maximal. Furthermore, since the luminance of the display unit 100 is changed satisfying Equation (1), a user may not perceive the change in the luminance. Accordingly, the power saving function of the display device 10 may be performed without the user feeling that it is unnatural. An example of a luminance change is described below with reference to FIG. 4.

Figure 4:
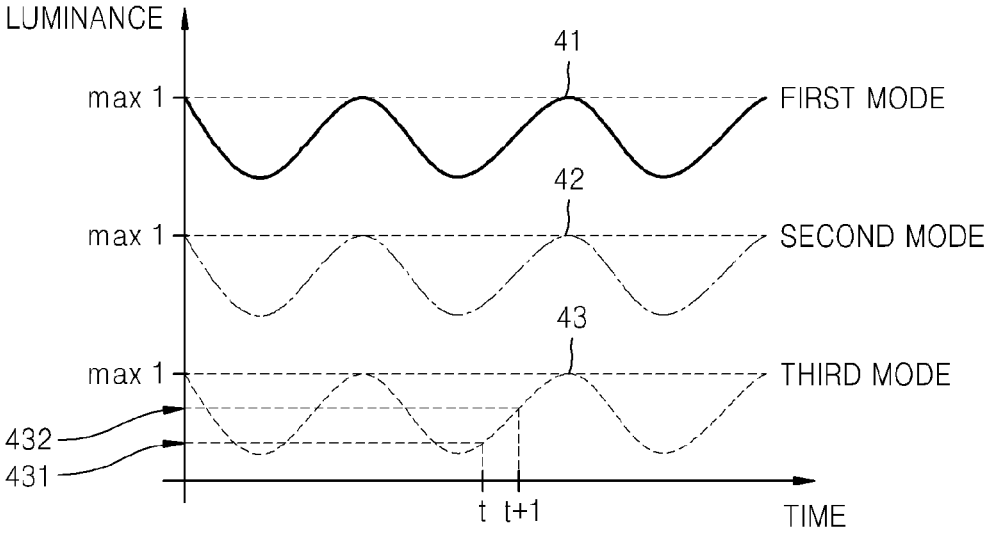
FIG. 4 is a graph illustrating another example in which luminance is controlled by the control unit of FIG. 2B.

FIG. 4 is a graph illustrating another example in which luminance is controlled by the control unit 200 of FIG. 2B. A curve 41 of FIG. 4 indicates a change in luminance when the first mode is selected by the mode selection unit 230. A curve 42 indicates a change in luminance when the second mode is selected by the mode selection unit 230. A curve 43 indicates a change in luminance when the third mode is selected by the mode selection unit 230.

Although FIG. 4 exemplarily illustrates the first to third modes, the types and number of modes are not limited thereto. The types and number of modes selected by the mode selection unit 230 may be variously set, as necessary.

The plurality of modes may differently set the maximal luminance of the display unit 100. Referring to FIG. 4, the maximal luminance of the display unit 100 may be max1 when the first mode is selected, the maximal luminance of the display unit 100 may be max2 when the second mode is selected, and the maximal luminance of the display unit 100 may be max3 when the third mode is selected.

The horizontal axis of the graph of FIG. 4 may represent time, and the vertical axis may represent the luminance of the display unit 100 as time passes. Referring to FIG. 4, the luminance of the display unit 100 may periodically alternate within a range not exceeding the maximal luminance max1 to max3 in respective modes.

The luminance of the display unit 100 may periodically alternate as illustrated in FIG. 4. Here, regarding an interval of changing the luminance of the display unit 100, as described above, the luminance of the display unit 100 may be changed whenever the display device 10 consumes power by as much as the certain amount or may be changed as time passes. In FIG. 4, the horizontal axis represents the time in order to illustrate that the luminance of the display unit 100 is changed as time passes.

For instance, the luminance may be changed whenever the time elapses by as much as a unit time 1 as described below. Here, the unit time may be one second or one minute, or may be variously set. Referring to FIG. 4, when the time elapses by as much as the unit time 1 from t and becomes t+1 in the third mode, the luminance calculation unit 210 may calculate a second luminance 432 of the display unit 100 from Equation (1) considering a first luminance 431 of the display unit 100 and the constant K determined by Weber's law.

As the luminance is repeatedly calculated based on Equation (1), the luminance of the display unit 100 may be calculated as indicated by the curves 41 to 43, and may periodically alternate as indicated by the curves 41 to 43. Periods of these curves may be preset to appropriate values.

For instance, in the case where the alternating period of the luminance is 10 seconds and the unit time is 1 second, the luminance calculation unit 210 may decrease the luminance five times and then may increase the luminance five times so that the luminance of the display unit 100 periodically alternates. However, this is just an example, and the luminance of the display unit 100 may be allowed to periodically alternate using variously modified control methods.

The respective maximal and minimal values of the curves 41 to 43 of FIG. 4 may satisfy Weber's law. That is, the ratio of a difference between the maximal value and the minimal value to the maximal value, or a ratio of the difference between the maximal value and the minimal value to the minimal value, may be less than Weber's constant. Here, as described above, Weber's constant K may be preset by a user, and the lookup table generated by pre-obtaining the values of the Weber's constants corresponding to respective situations may be referred to.

Since Equation (1) is based on Weber's law, when the luminance of the display unit 100 is changed to the second luminance 432 calculated from Equation (1) considering the first luminance 431 and the constant K determined according to Weber's law, a user may not perceive the change in the luminance of the display unit 100. That is, when the luminance of the display unit 100 is gradually changed as indicated by the curves 41 to 43, the user may not perceive the change in the luminance of the display unit 100. Accordingly, the power saving function of the display device 10 may be performed without the user feeling that it is unnatural.

Although the horizontal axis of FIG. 4 represents time in order to illustrate that the luminance of display unit 100 is controlled based on the passage of time, the horizontal axis is not limited thereto. The luminance of the display unit 100 may be controlled according to the remaining power of the display device 10. In this case, the horizontal axis of FIG. 4 may represent the remaining power of the display device 10.

Although FIG. 4 illustrates that the luminance of the display unit 100 alternates in the shape of a cosine or sine wave, this is just an example for convenience, and thus the luminance is not limited thereto. The luminance of the display unit 100 may decrease along a straight line and then increase along a straight line repeatedly so as to periodically alternate, or may have other waveforms of various periodic functions.

Figure 5:
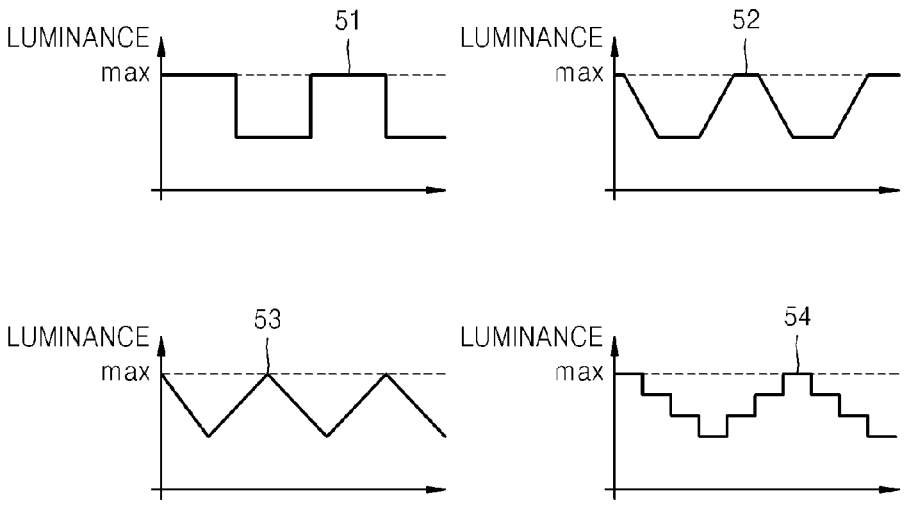
FIG. 5 illustrates another example in which luminance of a display unit periodically alternates.

FIG. 5 illustrates another example in which the luminance of the display unit 100 periodically alternates. Referring to FIG. 5, the luminance of the display unit 100 may alternate in the shape of a square wave as indicated by a graph 51, may alternate in the shape of a trapezoidal wave as indicated by a graph 52, may alternate in the shape of a triangular wave as indicated by a graph 53, or may alternate in the shape of a step wave as indicated by a graph 54. The luminance of the display device 100 may be changed in the shape of any periodic alternating function.

Regarding the graphs 51 to 54, when the luminance of the display unit 100 is changed in a unit of the remaining power of the display device 10 or a unit of time, the first luminance before the change and the second luminance after the change always satisfy Equation (1). Accordingly, even if the luminance of the display unit 100 periodically alternates as indicated by the graphs 51 to 54, a user may not perceive the change in the luminance, and thus the power saving function of the display device 10 may be performed without the user feeling that it is unnatural.

Furthermore, as described above, in the graphs 51 to 54, the maximal and minimal values of the luminance of the display unit 100 may satisfy Weber's law. That is, in each graph, a ratio of a difference between the maximal value and the minimal value to the maximal value, or a ratio of the difference between the maximal value and the minimal value to the minimal value, may be less than Weber's constant.

Figure 6:
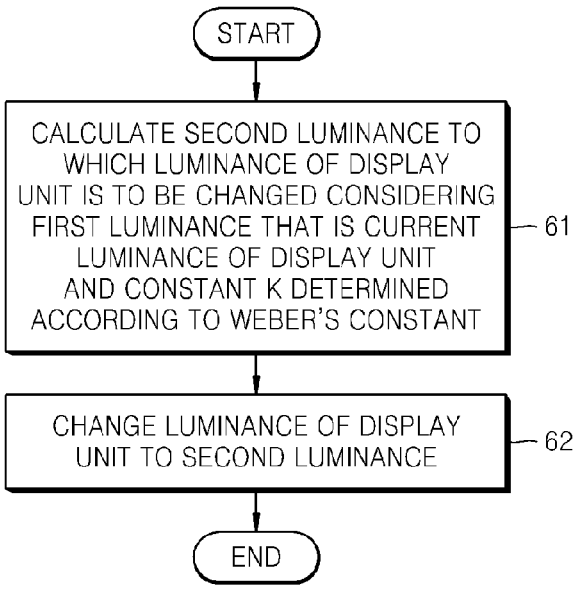
FIG. 6 is a flowchart illustrating a method of controlling a display device according to an embodiment of the present invention.

FIG. 6 is a flowchart illustrating a method of controlling a display device, according to an embodiment of the present invention. Referring to FIG. 6, in operation 61, the luminance calculation unit 210 may calculate the second luminance to which the luminance of the display unit is to be changed, considering the first luminance that is a current luminance of the display unit and the constant K determined according to Weber's law.

The constant K may be Weber's constant. According to an embodiment of the present invention, the second luminance calculated in operation 61 may be lower than the first luminance. According to another embodiment of the present invention, the second luminance calculated in operation 61 may be lower or higher than the first luminance. Accordingly, the luminance of the display unit 100 may periodically alternate. The maximal and minimal values of the luminance of the display unit 100 may satisfy Equation (1) when the luminance periodically alternates.

In operation 62, the luminance control unit 220 may change the luminance of the display unit 100 to the second luminance calculated in operation 61. Operations 61 and 62 may be repeated according to the remaining power of the display device 10 or a time interval.

According to another embodiment of the present invention, the display device controlling method of FIG. 6 may further include an operation for selecting one of a plurality of modes differentiated by maximal luminance of the display unit 10 according to a selection by a user. Accordingly, in operation 61, the second luminance may be calculated further considering the selected mode.

Here, the maximal luminance may be the luminance obtained when the remaining power of the display device 10 is 100%, or the maximal luminance may be a maximum value of the luminance of the display unit 100 when the luminance of the display unit 100 periodically alternates. In this case, the luminance of the display unit 100 may periodically alternate within a range not exceeding the maximal luminance corresponding to the selected mode.

It has been described that the luminance of the display unit 100 is controlled from when the remaining power of the display device 10 is about 100%. However, according to a modified embodiment of the present invention, the control unit 200 may begin to control the luminance of the display unit 100 when the remaining power of the display device 10 is not greater than a preset certain reference value. That is, when the remaining power of the display device 10 is sufficient, the luminance is kept high, and when the remaining power decreases below the preset reference value, the luminance of the display unit 100 may be controlled in order to save power. This controlling method may be applied to the above-described embodiments of the present invention. The certain reference value may be set according to a selection by a user.

To select one from among the above-described various controlling methods of the control unit 200, the display device 10 may select the controlling method according to an input from a user, or an appropriate controlling method may be selected according to use of the display device 10.

Furthermore, a user may select a degree of power saving of the display device 10, or may select a specific method for controlling the luminance of the display unit 100 to save power. Therefore, the above-described embodiments may be variously modified as necessary when the present invention is carried out. Accordingly, the user may appropriately adjust the luminance of the display unit 100 and the degree of power saving.

According to the above-described embodiments, by controlling the luminance of the display unit 100 based on the minimal difference recognizable by a user, the power consumption of the display device may be reduced without allowing the change in the luminance of the display unit 100 to be perceived by the user.

According to a typical power saving method for a display, if a user selects a specific luminance, the selected luminance is selected regardless of the remaining power or passage of time. The user selects lower luminance to save power. Therefore, the effects of power saving performed according to the remaining power or passage of time may not be obtained.

Conversely, according to the above-described embodiments, the luminance is gradually changed in proportion to the remaining power, and thus the power consumption is reduced by as much as the reduced luminance without allowing the change in the luminance to be recognized by the user. Therefore, power may be saved by as much as the reduced luminance in comparison with the case of maintaining a specific luminance.

The method of controlling the display device 10 illustrated in FIG. 6, according to an embodiment of the present invention, may be programmed to be executed by a computer, and may be implemented in a general digital computer which executes the program using a computer-readable recording medium. The computer-readable recording medium includes magnetic storage media (e.g., ROM, floppy disks, hard disks, etc.) and optical recording media (e.g., CD-ROMs and DVDs).

In the above-described embodiments, the constant K may be set within a range satisfying Weber's law. According to a value of the constant K, a degree of power saving according to an embodiment of the present invention may be adjusted. As the luminance is decreased, the power consumption is reduced.

For instance, as the constant K becomes smaller, the change in the luminance of the display unit 100 becomes smaller, and thus the luminance of the display unit 100 is slightly changed. Accordingly, saved power is reduced. Conversely, as the constant K becomes larger, the change in the luminance of the display unit 100 becomes greater. Accordingly, saved power is increased. However, even if the constant K is increased, the constant K may be within a range satisfying Weber's law.

According to the mode selected by the user, a degree of power saving according to an embodiment of the present invention may also be changed. When it is assumed that the constant K is the same, as the initial luminance according to the selected mode is large, the luminance is greatly changed, thereby saving more power.

For instance, when it is assumed that the same constant K is set, "power which is saved by changing luminance from an initial luminance of about 200 cd/m2 of the display unit 100 according to an embodiment of the present invention in comparison with the case of maintaining the luminance of about 200 cd/m2 of the display unit 100" is greater than "power which is saved by changing luminance from an initial luminance of about 100 cd/m2 of the display unit 100 according to an embodiment of the present invention in comparison with the case of maintaining the luminance of about 100 cd/$m^2$ of the display unit 100".

While the present invention has been particularly shown and described with reference to exemplary embodiments thereof, it will be understood by one of ordinary skill in the art that various changes in form and detail may be made therein without departing from the spirit and scope of the present invention as defined by the following claims.

What is claimed is:

1. A method of controlling a luminance of a display unit to save power of a display device comprising the display unit for displaying on a screen, the method comprising the steps of:

calculating a second luminance L2 to which the luminance of the display unit is to be changed considering a first luminance L1 that is a current luminance of the display unit and a constant K determined according to Weber's law; and changing the luminance of the display unit to the second luminance L2;

wherein $$\left|\frac{L2 - L1}{L1}\right| \leq K;$$

and wherein the calculating of the second luminance and the changing of the luminance are repeated according to remaining power of the display device.

2. The method of claim 1, the constant K being Weber's constant.

3. The method of claim 1, the second luminance being lower than the first luminance.

4. The method of claim 1, the calculating of the second luminance and the changing of the luminance being repeated according to the remaining power of the display device and a time interval.

5. The method of claim 1, further comprising the step of selecting one of a plurality of modes differentiated by a maximal luminance of the display device according to a selection by a user;

the calculating of the second luminance further comprising considering the selected mode to calculate the second luminance.

6. The method of claim 5, the maximal luminance being a luminance of the display unit when remaining power of the display device is about 100%.

7. The method of claim 1, the second luminance being calculated so that the luminance of the display unit periodically alternates.

8. The method of claim 7, further comprising the step of selecting one of a plurality of modes differentiated by a maximal luminance of the display unit according to a selection by a user;

the luminance of the screen periodically alternating within a range not exceeding the maximal luminance corresponding to the selected mode.

9. A computer which is programmed to execute the method of claim 1.

10. A device for controlling a luminance of a display unit to save power of a display device comprising the display unit for displaying on a screen, the device comprising:

a luminance calculation unit configured to calculate a second luminance L2 to which the luminance of the display unit is to be changed considering a first luminance L1 that is a current luminance of the display unit and a constant K determined according to Weber's law; and a luminance control unit configured to change the luminance of the display unit to the second luminance L2;

wherein $$\left|\frac{L2 - L1}{L1}\right| \leq K;$$

and wherein the calculating of the second luminance and the changing of the luminance are repeated according to remaining power of the display device.

11. The device of claim 10, the constant K being Weber's constant.

12. The device of claim 10, the second luminance being lower than the first luminance.

13. The device of claim 10, the luminance calculation unit and the luminance control unit repeating the calculating and changing of the luminance according to the remaining power of the display device and a time interval.

14. The device of claim 10, further comprising a mode selection unit configured to select one of a plurality of modes differentiated by a maximal luminance of the display device according to a selection by a user;

the luminance calculation unit further considering the selected mode to calculate the second luminance.

15. The device of claim 14, each of the modes being a luminance of the display unit when remaining power of the display device is about 100%.

16. The device of claim 10, the luminance calculation unit calculating the second luminance so that the luminance of the display unit periodically alternates.

17. The device of claim 16, further comprising a mode selection unit configured to select one of a plurality of modes differentiated by a maximal luminance of the display unit according to a selection by a user;

the luminance of the display unit periodically alternating within a range not exceeding the maximal luminance corresponding to the selected mode.

18. A method of controlling a luminance of a display unit to save power of a display device comprising the display unit for displaying on a screen, the method comprising the steps of:

calculating a second luminance L2 to which the luminance of the display unit is to be changed considering a first luminance L1 that is a current luminance of the display unit and a constant K determined according to Weber's law; and changing the luminance of the display unit to the second luminance L2 so as to obtain a just noticeable difference JND that is a minimal difference noticeable by a user;

wherein $$K = \frac{JND}{L1}.$$

19. The method of claim 18, the constant K being Weber's constant.

20. The method of claim 18, the calculating of the second luminance and the changing of the luminance being repeated according to one of a remaining power of the display device and a time interval.

* * * * *